US006254250B1

(12) United States Patent
Shieh

(10) Patent No.: US 6,254,250 B1
(45) Date of Patent: Jul. 3, 2001

(54) DECORATIVE LIGHT TREE SET

(76) Inventor: Whiter Shieh, 6F, No.245, Tun Hua South Road, Sec.1, Taipei, 106 (TW)

( * ) Notice: Subject to any disclaimer, the term of this patent is extended or adjusted under 35 U.S.C. 154(b) by 0 days.

(21) Appl. No.: 09/419,096

(22) Filed: Oct. 15, 1999

(51) Int. Cl.[7] ..... F21S 6/00
(52) U.S. Cl. ..... 362/123; 362/252; 362/391
(58) Field of Search ..... 362/123, 252, 362/391, 431, 806

(56) References Cited

U.S. PATENT DOCUMENTS 3,704,366 * 11/1972 Korb et al. ..... 362/123
5,712,002 * 1/1998 Reilly, III ..... 362/123 X
6,062,701 * 5/2000 Hines ..... 362/123

* cited by examiner

*Primary Examiner*—Stephen Husar
(74) *Attorney, Agent, or Firm*—Dougherty & Troxell

(57) ABSTRACT

A decorative light tree set for supporting light strings thereon is disclosed. The decorative light tree set includes a rigid central post fixed to and upstanding on ground and a plurality of primary ropes extending from a top end of the central post at a predetermined inclining angle with lower ends thereof fixed to the ground by fasteners. A plurality of light strings horizontally extend between each primary rope and the central post. A number of secondary ropes vertically extend from each primary rope and interconnect the light strings forming a net-like structure whereby the light strings are securely maintained in position between the primary ropes and the central post. Electrical wires having a plug extend along the central post and are electrically connected to the light strings for supplying electrical power energy to the light strings.

11 Claims, 5 Drawing Sheets

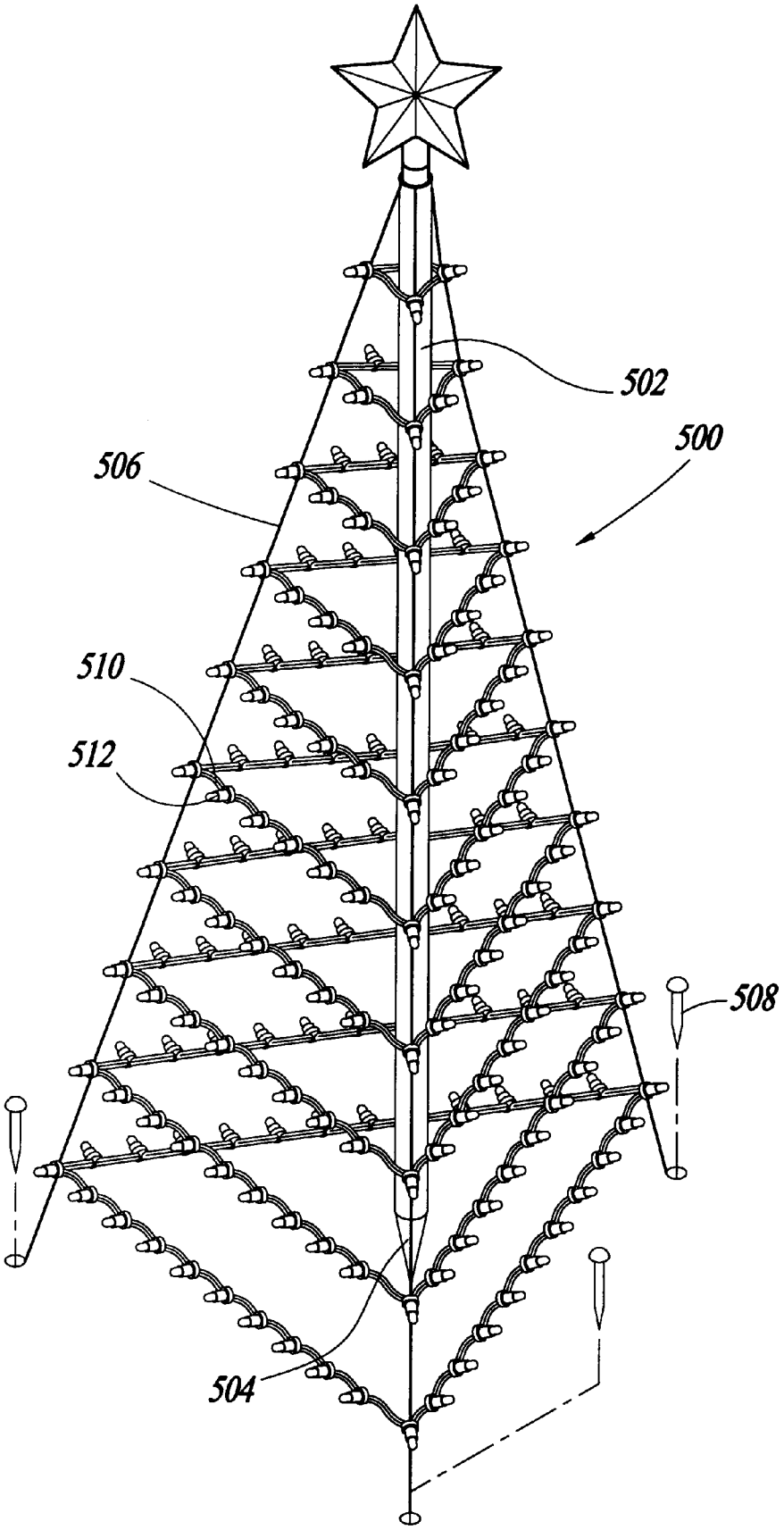
502
500
506
510
512
508
504

DECORATIVE LIGHT TREE SET

BACKGROUND OF THE INVENTION

1. Field of the Invention

The present invention generally relates to a decorative light set, and in particular to a decorative light tree set for supporting decorative light strings thereon. The decorative light tree set mainly comprises a rigid central post, a plurality of primary ropes, and a plurality of secondary ropes, incorporating with light strings, to form a decorative light tree.

2. Description of the Prior Art

Decorative light strings are widely used in holidays and festivals, especially Christmas. A light string usually comprises electrical wires on which a plurality of lamp sockets are mounted for receiving lamps. Since the electrical wires are usually not rigid enough to support themselves in the space, a supporting frame is commonly adapted to support and arrange the light strings into desired shapes.

Conventionally, the frame is made of metal or plastic bars to form a supporting frame for the light strings. An example of the prior art supporting frame for decorative light is disclosed in U.S. Pat. No. Des. 408,319 issued Apr. 20, 1999, issued to Byers entitled "Decorative Light Tree". Such a supporting frame requires a great amount of space in storage. Some of the light string supporting frames have a knockdown structure allowing a user to detach/disassemble parts thereof thereby reducing the amount of space required for storage. However, the rigid components of the supporting frame still occupy quite an amount of space in storage.

Another example of the prior art supporting frame for decorative light is disclosed in U.S. Pat. No. 4,736,282 issued Apr. 5, 1988, issued to Ahroni entitled "Decorative Light Assembly with Tree Collar". Such a decorative light assembly requires a collar adapted to be mounted on a tree trunk near the top of the tree. The collar has a complicated structure comprising a ring-shaped container with slots in its outer wall through which the light string passes to form unlighted retained loops inside the container and outside lighted loops draping from the container.

It is thus desirable to have a light tree set for supporting decorative light strings to overcome the problems discussed above.

SUMMARY OF THE INVENTION

Accordingly, a primary object of the present invention is to provide a light tree set suitable to support light strings thereon for decorative purposes without need of supporting frame.

The other object of the present invention is to provide a decorative light tree set which is easy to assemble. Furthermore, the decorative light tree set is preferably composed of flexible members thereby facilitating storage thereof.

To achieve the above objects, in accordance with the present invention, there is provided a decorative tree light set comprising a rigid central post adapted to be fixed to and upstanding on a fixed surface such as ground and a plurality of primary ropes extending from a top end of the central post at a predetermined inclining angle with lower ends thereof fixed to the ground by fasteners. A plurality of light strings horizontally extend between each primary rope and the central post. A number of secondary ropes may vertically extend from each primary rope and interconnect the light strings forming a net-like structure whereby the light strings are securely maintained in position between the primary ropes and the central post. Electrical wires having a plug for connection with an electrical power source extend along the central post and are electrically connected to the light strings for supplying electrical power energy thereto. Preferably, an electronic controller incorporating a control circuit therein for controlling the lightening of the lamps arranged on the electrical wires is connected between the light strings and the plug.

BRIEF DESCRIPTION OF THE DRAWINGS

The present invention will be apparent to those skilled in the art by reading the following description of preferred embodiments thereof, with reference to the accompanying drawings, in which:

FIG. 5 is a schematic perspective view of a decorative light tree set in accordance with a fifth embodiment of the present invention.

DETAILED DESCRIPTION OF THE PREFERRED EMBODIMENTS

Figure 1:
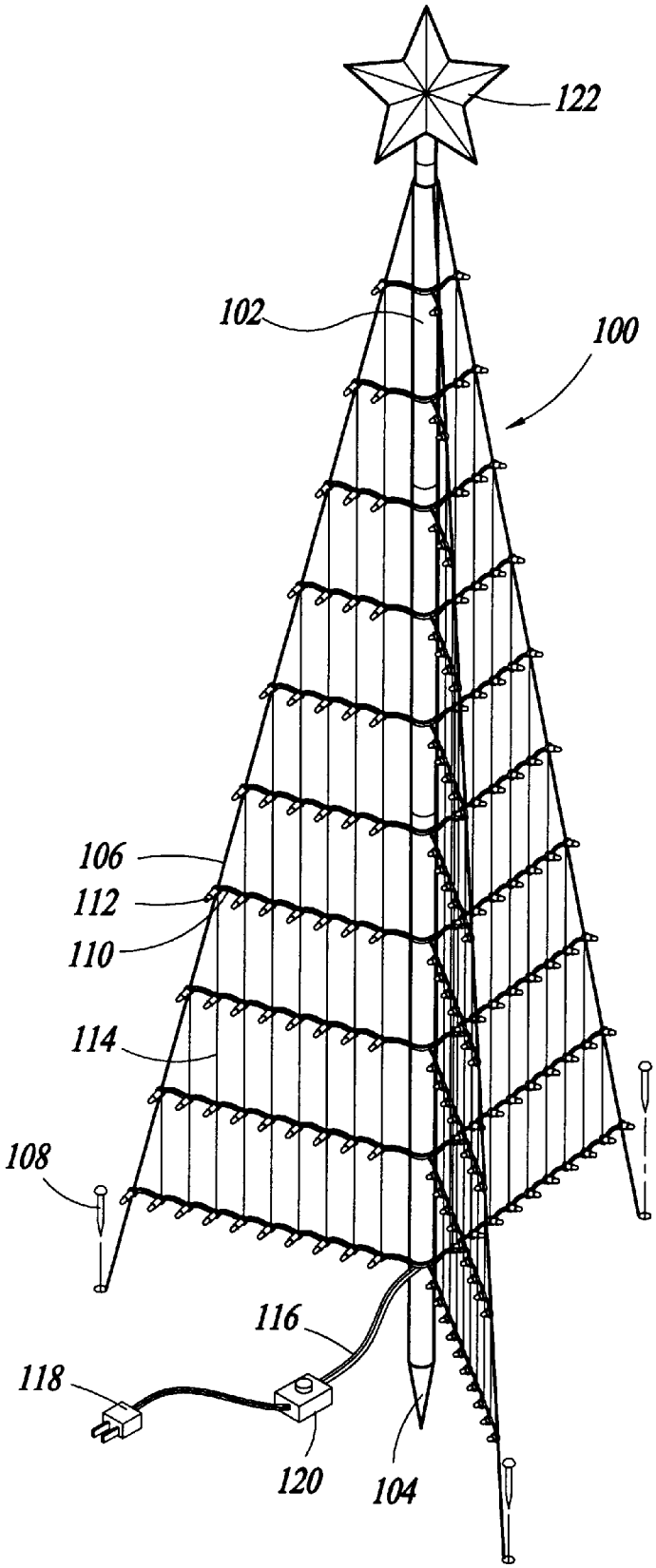
FIG. 1 is a schematic perspective view of a decorative light tree set in accordance with a first embodiment of the present invention.

With reference to the drawings and in particular to FIG. 1, a decorative light tree set constructed in accordance with a first embodiment of the present invention, generally designated with reference numeral 100, is shown. The decorative light tree set 100 comprises a rigid central post 102 having a lower end adapted to be positioned on a fixed surface (not shown) in an upstanding fashion. A cone section 104 is optionally mounted to the lower end of the central post 102 for supporting the central post 102 on the ground.

Preferably, the central post 102 comprises a plurality of sections that are releasably connected to each other for reducing the space required to store the central post. Alternatively, the sections of the central post 102 may be telescopically connected to each other.

At least one primary rope 106 extends from an upper end of the central post 102 to the ground at a predetermined inclining angle. For example, the primary rope 106, the central post 102 and the ground form a triangle. Preferably, the primary rope 106 is made of nonconductive natural fibers such as cotton, or synthetic fibers such as plastic fibers, or the mixtures thereof. The primary rope 106 ma[]y be attached to the central post 102 by any known means, for example by simply tying the rope 106 on the central post 102 or by clips.

In the embodiment illustrated in FIG. 1, three primary ropes 106 extend at a predetermined angle from the upper end of the central post 102 to the ground and is fixed to the ground by fasteners 108. The three primary ropes 106 are angularly equally spaced from each other about the central post 102 thereby securely retaining the central post 102 on the ground.

A plurality of light strings 110 horizontally extend between each primary rope 106 and the central post 102.

Each light string 110 has a first end attached to the primary rope 106 by any known means, such as a clip or tying a knot and a second end attached to the central post 102. Each light string 110 comprises electrical wires to which a number of lamps 112 are mechanically attached and electrically connected. The lamps 112 are spaced along the electrical wires, normally equally spaced.

A plurality of secondary ropes 114 vertically extend between and interconnects each primary rope 106 and the corresponding light strings 110. The vertically extending secondary ropes 114 may be attached to both the primary rope 106 and the light strings 110 by any suitable means, such as clip or tying a knot, for securely retaining the light strings 110 in position.

A power supply cable 116 extends along the central post 102 and is electrically connected to the light strings 110. The power supply cable 116 may extend through a central bore (not shown) defined in the central post 102 or alternatively, the power supply cable 116 may be received in and coextensive with a longitudinal groove (not shown) defined in the central post 102 or the power supply cable 116 may be fixed to an outside surface of the central post 102 by clips or wires (not shown). The power supply cable 116 has a remote end to which an electrical plug 118 is mounted for connection with a wall outlet (not shown).

An electronic controller 120 comprising a control circuit which is known to those skilled in the art may be used to control the lightening sequence and patterns of the lamps 112. The controller 120 may be replaced by known flashing control lamps that comprise bimetal contacts that switch on/off based on temperature thereof. This is also well known and no further details will be given herein.

The inclination of the primary ropes 106 from the upper end of the central post 102 to the ground forms the shape of a light tree. A star-shaped hollow member 122 may be attached to the upper end of the central post 102 with a number of lamps 126 mounted therein and powered by the power supply cable 116.

Figure 2:
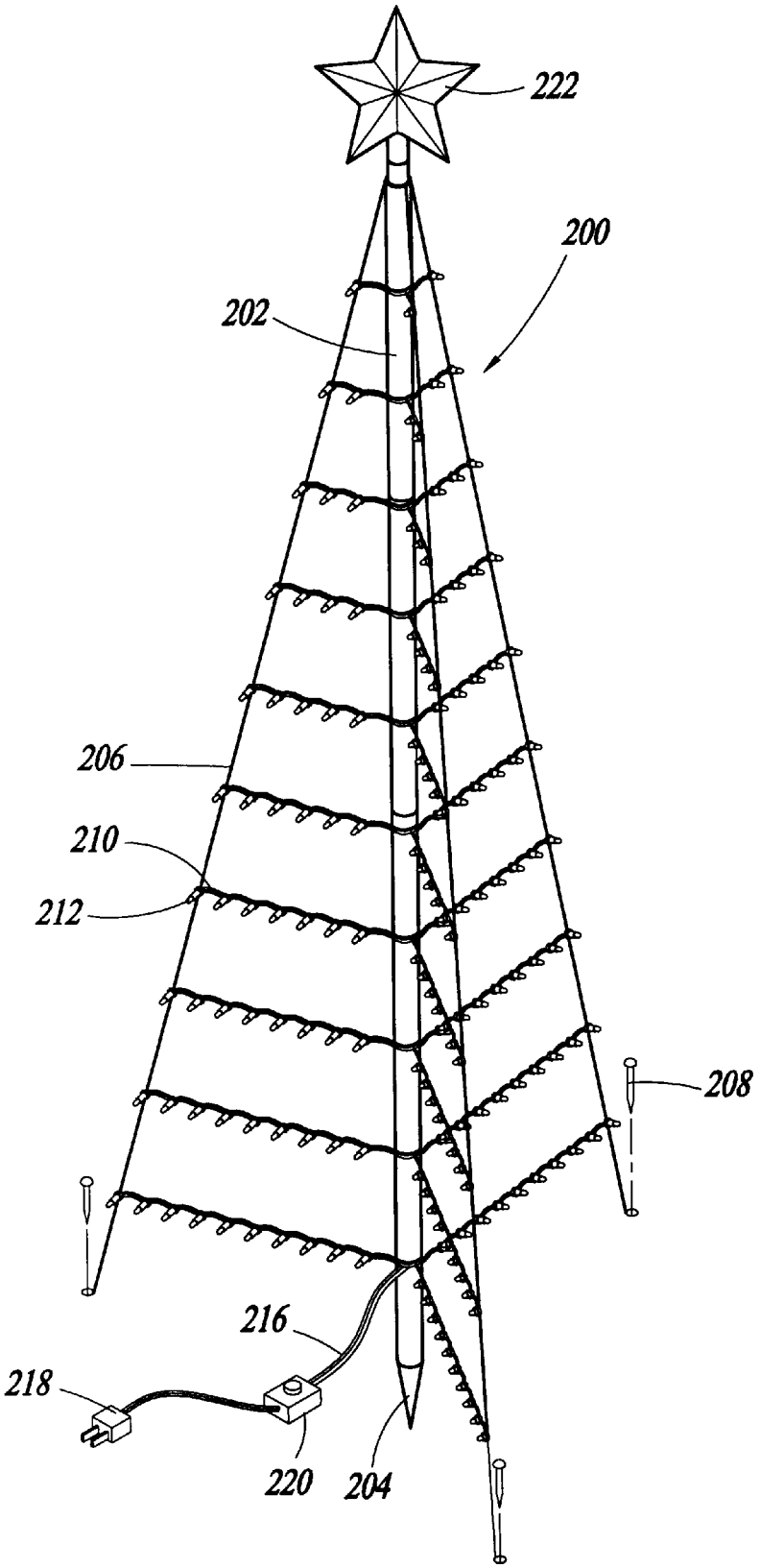
FIG. 2 is a schematic perspective view of a decorative light tree set in accordance with a second embodiment of the present invention.

FIG. 2 of the attached drawings shows a second embodiment in accordance with the present invention. A decorative light tree set in accordance with the second embodiment, designated with reference numeral 200, has a structure similar to that of the first embodiment illustrated in FIG. 1. In other words, the decorative light tree set 200 comprises a central post 202 supported on the ground. A cone section 204 is optionally mounted to the lower end of the central post 202 for supporting the central post 202 on the ground.

Three primary ropes 206 extend from an upper end of the central post 202 to the ground at a predetermined angle and fixed to the ground by fasteners 208. A plurality of light strings 210 extend between each primary rope 206 and the central post 202 in a horizontal direction. Each light string 210 comprises electrical wires and lamps 212 mechanically and electrically connected to the electrical wires.

A power supply cable 216 extends along the central post 202 and is electrically connected to the electrical wires of the light strings 210. The power supply cable 216 has a plug 218 for connection with a wall outlet (not shown).

An electronic controller 220 comprising a control circuit may be used to control the lightening sequence and patterns of the lamps 212. The controller 220 may be replaced by known flashing control lamps that comprise bimetal contacts that switch on/off based on temperature thereof. A star-shaped member 222 containing a number of lamps therein may be attached to the upper end of the central post 202.

The difference between the second embodiment shown in FIG. 2 and the first embodiment shown in FIG. 1 is that the vertically extending secondary ropes 114 of the first embodiment are eliminated in the second embodiment. For a small sized Christmas tree formed in accordance with the present invention, the lamps 212 and the light strings may be effectively maintained in position by properly stretching the primary ropes 206 and the wires of the light strings 210. Elimination of the secondary ropes does not cause undesired effect on the formation of the tree.

Figure 3:
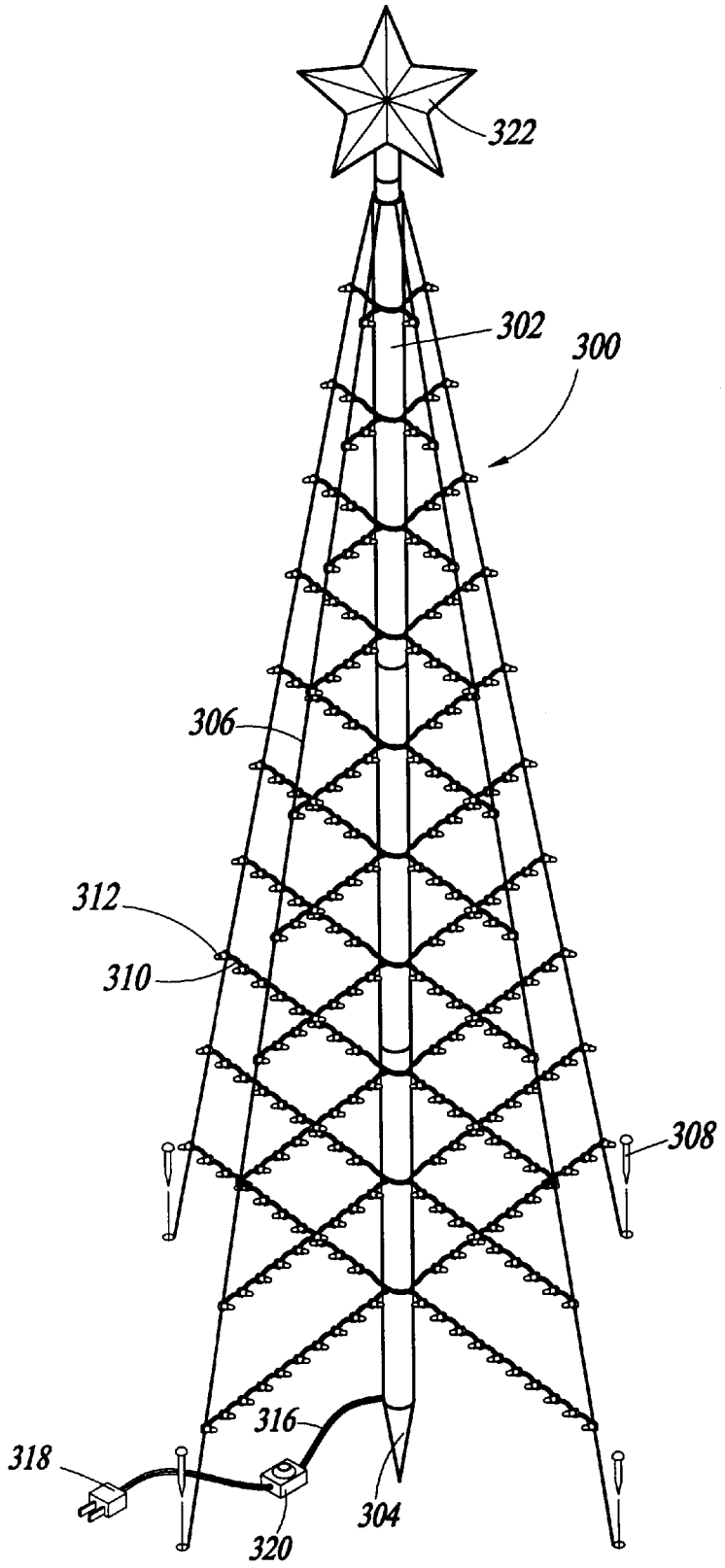
FIG. 3 is schematic perspective view of a decorative light tree set in accordance with a third embodiment of the present invention.

FIG. 3 of the attached drawings shows a third embodiment in accordance with the present invention. A decorative light tree set in accordance with the third embodiment, designated with reference numeral 300, has a structure similar to that of the first embodiment illustrated in FIG. 1 but comprises more primary ropes. In other words, the decorative light tree set 300 comprises a central post 302 supported on the ground by a cone section 304. Four primary ropes 306 extend from an upper end of the central post 302 to the ground at a predetermined angle and fixed to the ground by fasteners 308.

A plurality of light strings 310 extend between each primary rope 306 and the central post 302 in a horizontal direction. Each light string 310 comprises electrical wires and lamps 312 mechanically and electrically connected to the electrical wires 312.

Similar to the first embodiment shown in FIG. 1, a plurality of vertically extending secondary ropes (not shown) may extend between each primary rope 306 and interconnects the corresponding light strings 310 for maintaining the light strings 310 in position. The secondary ropes are eliminated as shown in the drawing.

A power supply cable 316 extends along the central post 302 and is electrically connected to the electrical wires of the light strings 310. The power supply cable 316 has a plug 318 for connection with a wall outlet (not shown). An electronic controller 320 is also used to control the lightening sequence and patterns of the lamps 312. A star-shaped member 322 containing a number of lamps therein may be attached to the upper end of the central post 302.

It is apparent to those skilled in the art that more than four primary ropes may be used to connect between the upper end of the central post and the ground. For example, five or six primary ropes may be used. Preferably, the primary ropes are angularly equally spaced about the central post. However, if desired, the primary ropes may be arranged in an angularly un-equally spaced fashion.

Figure 4:
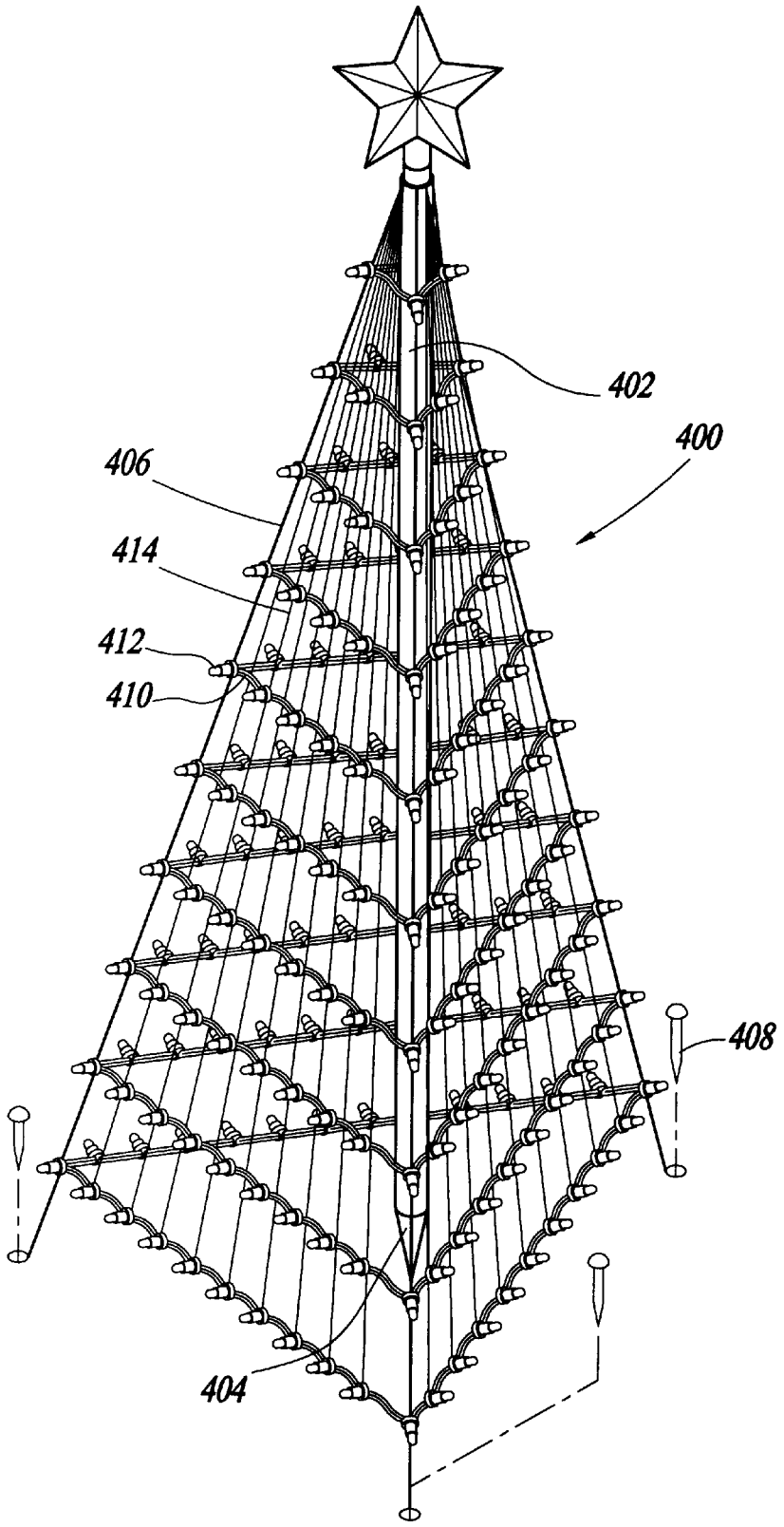
FIG. 4 is schematic perspective view of a decorative light tree set in accordance with a fourth embodiment of the present invention.

FIG. 4 of the attached drawings shows a fourth embodiment in accordance with the present invention. Similar to the first embodiment illustrated in FIG. 1, a decorative light tree set in accordance with the fourth embodiment, designated with reference numeral 400, comprises a central post 402 supported on the ground by a cone section 404. Three primary ropes 406 extend from an upper end of the central post 402 to the ground at a predetermined angle and fixed to the ground by fasteners 408.

A plurality of light strings 410 extend between adjacent primary ropes 406 in a horizontal direction thereby forming a pyramid configuration. The light strings 410 may be fixed to the primary ropes 406 by any suitable means as discussed above. Each light string 410 comprises electrical wires and a number of lamps 412 mechanically and electrically connected to the electrical wires.

A number of secondary ropes 414 extend between and interconnect each primary ropes 406 and the light strings 410 in a direction substantially normal to the light strings 410 and are attached to the light strings 410 for firmly maintaining the light strings 410 in position.

The decorative light tree set in this embodiment is also provided with a power supply cable, a plug, and an electronic controller, not shown in the drawing.

FIG. 5 of the attached drawings shows a fifth embodiment in accordance with the present invention. A decorative light tree set in accordance with the fifth embodiment, designated with reference numeral 500, has a structure similar to that of the fourth embodiment illustrated in FIG. 4. In other words, the decorative light tree set 500 comprises a central post 502 supported on the ground by a cone section 504. Three primary ropes 506 extend from an upper end of the central post 502 to the ground at a predetermined angle and are fixed to the ground by fasteners 508.

A plurality of light strings 510 extend between adjacent primary ropes 506 in a horizontal direction. Each light string 510 comprises electrical wires and lamps 512 mechanically and electrically connected to the electrical wires.

The decorative light tree set in this embodiment is also provided with a power supply cable, a plug, and an electronic controller, not shown in the drawing.

The difference between the fifth embodiment and the fourth embodiment is that the secondary ropes 414 of the fourth embodiment 400 are eliminated in the fifth embodiment.

Although the present invention has been described with reference to the preferred embodiments, it is apparent to those skilled in the art that a variety of modifications and changes may be made without departing from the scope of the present invention which is intended to be defined by the appended claims.

I claim:

1. A decorative light tree set for supporting light strings, comprising:

a rigid central post having an upper end and a lower end adapted to be positioned on a fixed surface with the central post extending therefrom in a first direction;

a plurality of primary ropes having first ends attached to the upper end of the central post and extending therefrom at a predetermined angle with respect to the first direction, lower ends of the primary ropes being attached to the fixed surface;

a plurality of light strings arranged between each primary rope and the central post;and a plurality of secondary ropes vertically connected between each primary rope and corresponding light strings to securely maintain the light strings in position.

2. The decorative light tree set as claimed in claim 1, wherein the central post comprises a plurality of sections detachably connected to each other.

3. The decorative light tree as claimed in claim 1, wherein the primary ropes are arranged to be angularly equally spaced with respect to the central post.

4. The decorative light tree as claimed in claim 1, wherein three primary ropes are arranged to extend from the upper end of the central post to the fixed surface.

5. The decorative light tree as claimed in claim 1, wherein four primary ropes are arranged to extend from the upper end of the central post to the fixed surface.

6. The decorative light tree as claimed in claim 1, further comprising a star-shaped hollow member attached to the upper end of the central post.

7. A decorative light tree set for supporting light strings, comprising:

a rigid central post having an upper end and a lower end adapted to be positioned on a fixed surface with the central post extending therefrom in a first direction;

a plurality of primary ropes having first ends attached to the upper end of the central post and extending therefrom at a predetermined angle with respect to the first direction, lower ends of the primary ropes being attached to the fixed surface;

a plurality of light strings arranged between adjacent primary ropes and a plurality of secondary ropes vertically connected between each primary rope and corresponding light strings to securely maintain the light strings in position.

8. The decorative light tree set as claimed in claim 7, wherein the central post comprises a plurality of sections detachably connected to each other.

9. The decorative light tree as claimed in claim 7, wherein the primary ropes are arranged to be angularly equally spaced with respect to the central post.

10. The decorative light tree as claimed in claim 7, wherein three primary ropes are arranged to extend from the upper end of the central post to the fixed surface.

11. The decorative light tree as claimed in claim 7, further comprising a star-shaped hollow member attached to the upper end of the central post.

* * * * *